US006363828B1

(12) United States Patent
Sherlock et al.

(10) Patent No.: US 6,363,828 B1
(45) Date of Patent: Apr. 2, 2002

(54) SHOCK DRIVEN PROJECTILE DEVICE

(75) Inventors: Mary Hilker Sherlock, Waldorf; Edward A. Lustig, Jr., Charlotte Hall; Edward DeLaney; Richard I. Gold, both of Indian Head; Steven Segletes, Bel Air, all of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/538,266

(22) Filed: Mar. 30, 2000

(51) Int. Cl.[7] ..... F42B 3/00

(52) U.S. Cl. ..... 89/1.13; 42/51; 42/84; 102/202.14; 102/304

(58) Field of Search ..... 42/51, 1.12, 84; 89/1.3, 1.13, 1.34, 36.74; 102/304, 306, 309, 202.14, 202.11, 202.9, 202.5

(56) References Cited

U.S. PATENT DOCUMENTS

| | | | | | |
|---|---|---|---|---|---|
| 229,058 | A | * | 6/1880 | Spencer | 89/1.34 |
| 3,248,504 | A | * | 4/1966 | McGirr et al. | |
| 4,150,266 | A | * | 4/1979 | Patrichi | 102/203 |
| 4,299,168 | A | * | 11/1981 | Montoya | 102/202.11 |
| 4,646,641 | A | * | 3/1987 | Casey | 102/306 |
| 5,016,537 | A | | 5/1991 | Pinson | |
| 5,303,633 | A | | 4/1994 | Guthrie et al. | |
| 5,743,246 | A | | 4/1998 | Mattern | |
| 5,936,184 | A | * | 8/1999 | Majerus | 89/1.13 |
| 6,131,515 | A | * | 10/2000 | Cook et al. | 102/202.8 |
| 6,219,951 | B1 | * | 4/2001 | Cate | 42/51 |

FOREIGN PATENT DOCUMENTS

| | | | | |
|---|---|---|---|---|
| CA | 2031230 | * | 5/1992 | 102/306 |
| DE | 303886 | * | 12/1919 | 89/1.3 |
| DE | 307065 | * | 5/1920 | 89/1.3 |
| GB | 128279 | * | 6/1919 | 89/1.3 |
| JP | 2275296 | * | 11/1990 | 42/84 |

* cited by examiner

*Primary Examiner*—Stephen M. Johnson
(74) *Attorney, Agent, or Firm*—Mark Homer

(57) ABSTRACT

This invention relates to a device for accurately delivering a ballistically stable, monolothic projectile at repeatable velocities to a specified target using an explosive event without causing deformation or fragmentation of the projectile. In its most preferred embodiment, the invention will deliver a projectile using an explosive event without substantial deformation or altering of the geometric shape of the projectile. This invention was specifically developed as a preferred device to render safe the firing train of the fuze mechanism of unexploded ordnance (UXO) to dispose of the UXO more safely.

15 Claims, 3 Drawing Sheets

Cross sectional view

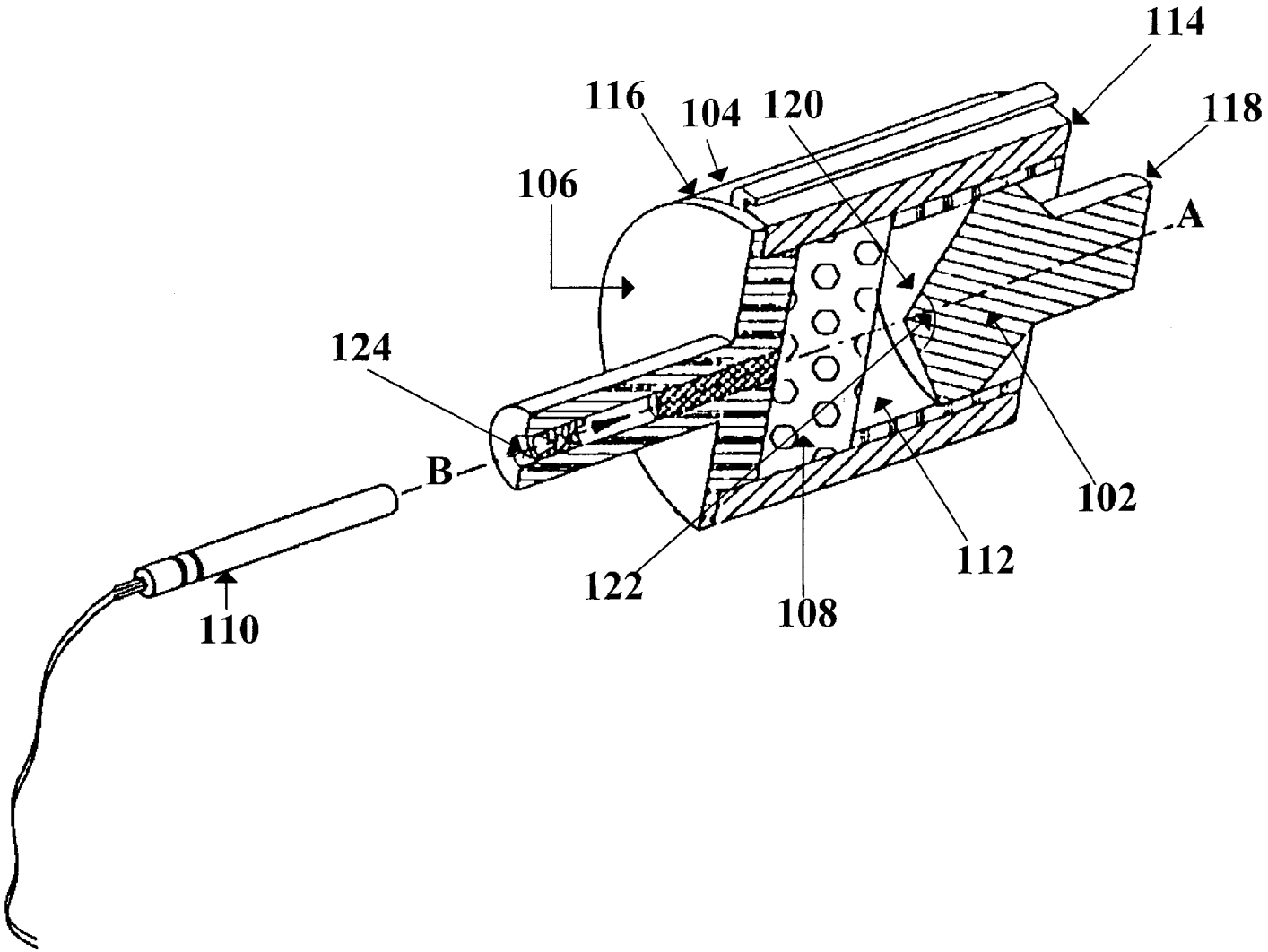
Figure 1. Cross sectional view

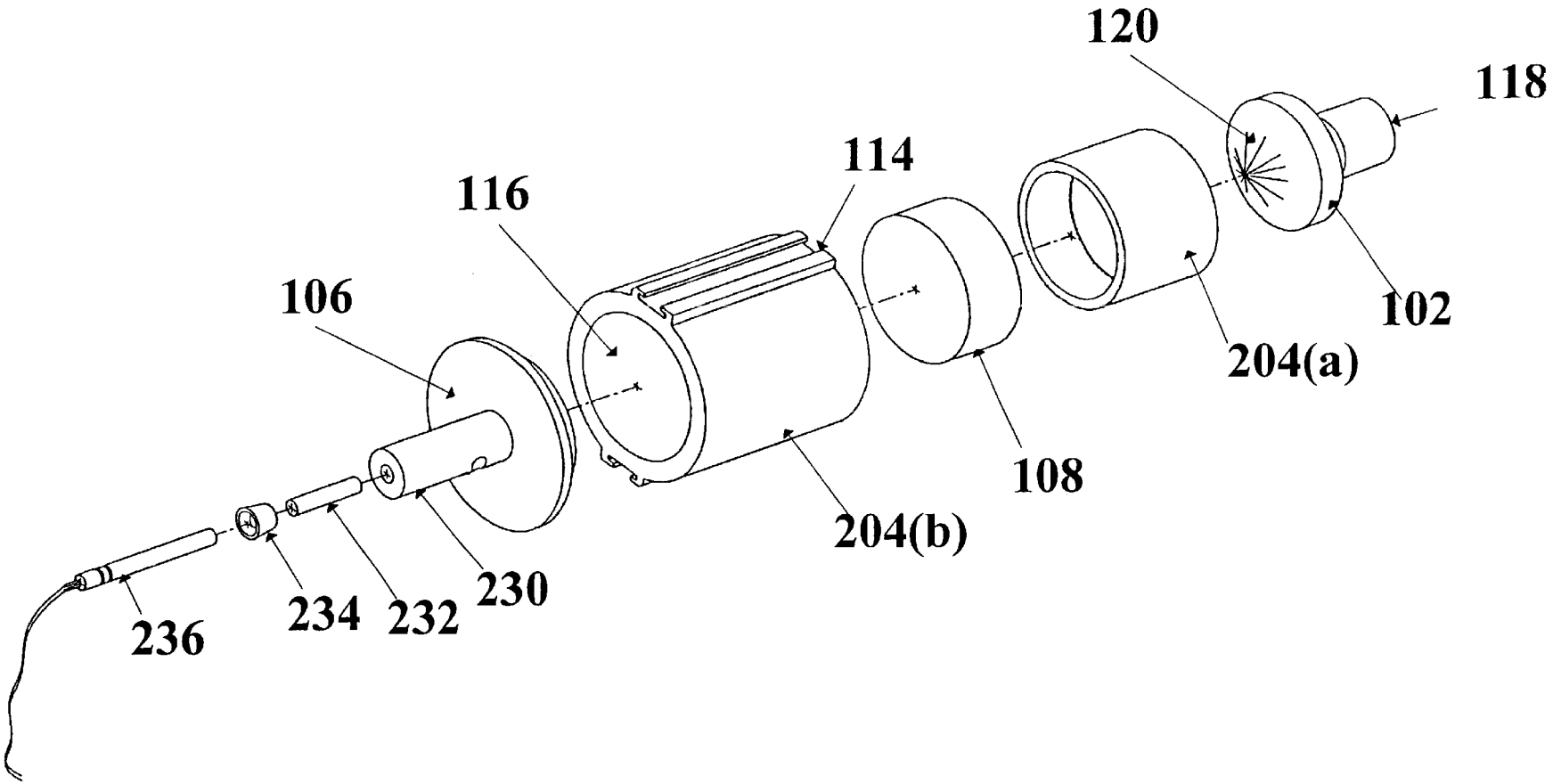
Figure 2. Exploded view

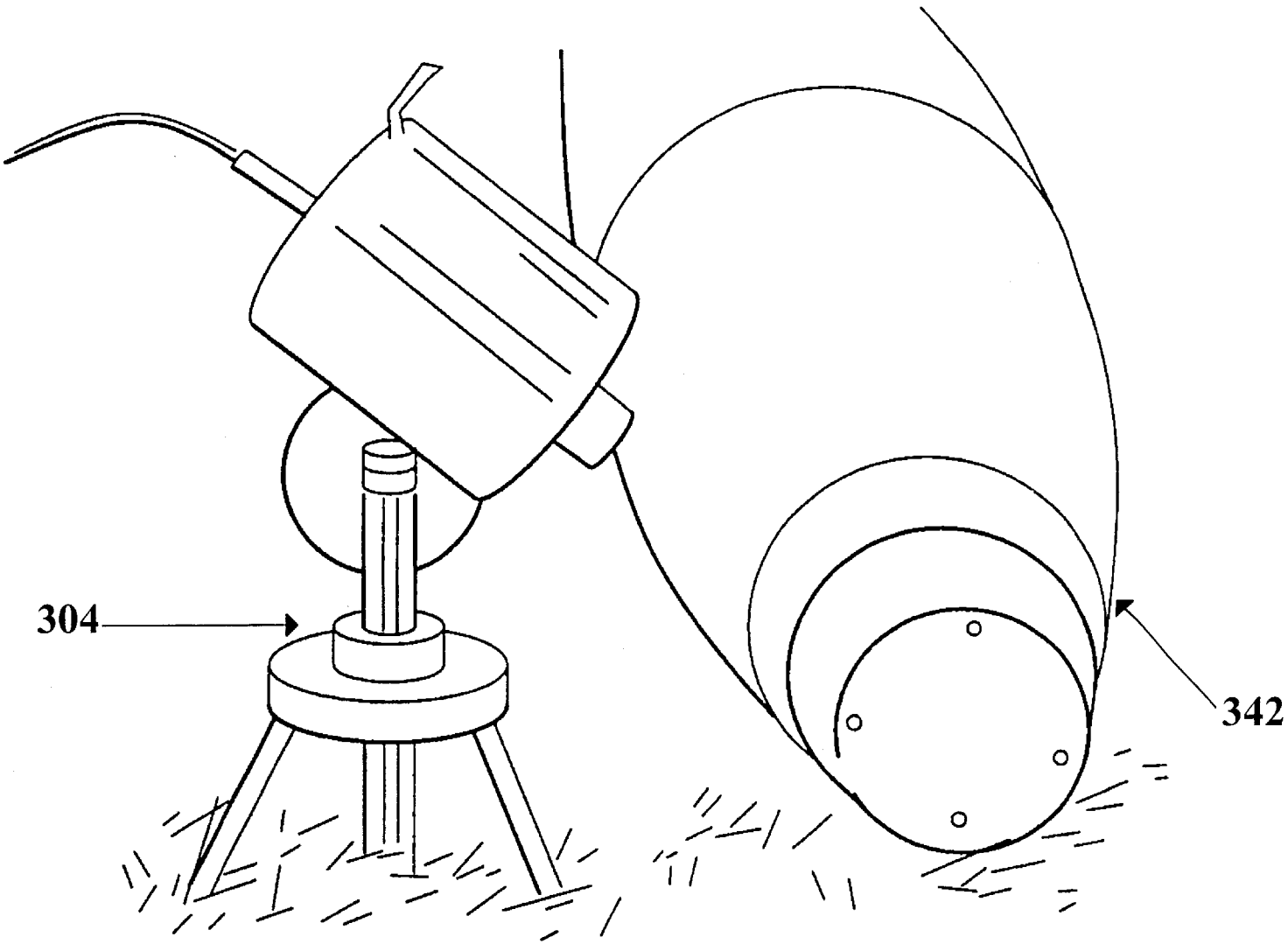
Figure 3. Field deployment configuration

SHOCK DRIVEN PROJECTILE DEVICE

STATEMENT OF GOVERNMENT INTEREST

The invention described herein may be manufactured and used by or for the Government of the United States of America for governmental purposes without payment of any royalties thereon or therefor.

BACKGROUND OF THE INVENTION

1. Field of the Invention

This invention relates to a device for accurately delivering a ballistically stable, monolothic projectile at repeatable velocities to a specified target using an explosive event without causing fragmentation, deformation, or alteration of the geometric shape of the projectile. Propelling a projectile using high explosives in such a manner is a new principal. In its most preferred embodiment, the invention will deliver a projectile using an explosive event without substantial deformation of the projectile. This invention was specifically developed as a preferred device to disable and render safe the firing train of the fuze mechanism of unexploded ordnance (UXO) to dispose of the UXO more safely.

2. Description of the Related Art 2.1 Propellant Technology

Prior to this invention, propellants were used to launch a projectile. Propellants, which are engineered to maintain a stable burning surface when confined, produce their energy in the form of gas, which is then used within a pressure vessel to propel a projectile. The rate of regression of a burning propellant surface is on the order of inches per second; this is in contrast to chemical reaction that progresses through detonating explosives at a rate exceeding the supersonic speed (i.e., faster than the speed of speed of sound) in the reaction zone. This transient pressure pulse that propagates as a supersonic velocity is termed shock wave. Typically, explosives react on the order of kilometers per second causing a sudden, almost instantaneous release of rapidly expanding hot gases, pressure, and heat creating a shock. In order to deliver a projectile without deforming or fragmenting that projectile, the current state of the art requires the use of propellants confined within a pressure vessel, such as a standard gun. In such a system, as the propellant burns, gas is released in a confined pressure vessel; this gas pressure is the source of mechanical energy which pushes or propels a projectile. Typically, a projectile is placed in a barrel, generally made of high-strength steel, with a propellant powder charge behind the projectile in a closed chamber. Upon initiation, the propellant burns, generating gas, which causes pressure to build on the rear of the projectile, propelling it down the barrel at increasing velocity. In order to conserve momentum, the gun barrel is propelled in a direction opposite to the projectile. This phenomenon is commonly termed recoil. The final velocity of the projectile is controlled by the amount and type of propellant charge used and the length and strength of confinement of the barrel.

2.2 Military Disposal of UXO

The military often must dispose of UXO such as mines and live ammunition under difficult conditions. In order to safely dispose of UXO, the firing train of the UXO must be jammed, removed or interrupted (disrupted) in order to render it safe, thus precluding its detonation or explosive functioning. The current method uses a gun system to drive a low velocity (650 foot per second or lower) projectile into the fuze mechanism, jamming the firing train components or interrupting/moving the firing train components out-of-line such that they can not function the UXO as designed. The firing train consists of combustible and explosive elements arranged in order of decreasing sensitivity. A fuze explosive train may consist of a primer, a detonator, a delay, a relay, a lead and a booster charge used in combination to generate suitable energy to actuate the main charge. The momentum (velocity and mass dependant) of the projectile must be of a sufficient magnitude to effectively penetrate and disrupt the fuze by move the fuzing train/component(s) out-of-line or to decapitate the fuze from the UXO components without initiating an energetic response in the fuzing/initiation train. As such, the projectile velocity must be minimal enough so the shock delivered by the projectile impacting the UXO fuze does not cause an explosive response in the fuze firing train components.

For the above purpose, however, use of a gun system to deliver a projectile is operationally cumbersome and inefficient. Gun systems that deliver a projectile with a velocity sufficient for this purpose have significant recoil. Since any UXO disruption must be initiated remotely to ensure the safety of personnel, a recoil compensation device must be employed to insure the recoil does not alter the aiming of the gun device before the projectile exits the barrel or cause collateral damage to rearward surrounding areas. Also, due to recoil forces and the ricochet potential of the reusable gun components, it is possible to lose the gun components in heavy brush, marsh, and woodland terrain, potentially exposing the operator to unnecessary risks when retrieving components for reuse in areas involving multiple UXO hazards. For UXO firing train disruption purposes, the current state of the art gun systems must be cleaned, loaded, and reassembled, assuming all of the components can be located, and, therefore, are not adapted for rapid UXO clearance conducted under operational conditions. Gun systems are also inherently heavy due to the pressure vessel (barrel and breach) components necessary to contain the operating gas pressure of the gun system.

2.3 Explosive Technology

Currently, explosive energy, which reacts on the order of 1 to 10 km/sec, is generally used to deform material. For instance, current state of the art systems use explosives to deliver material by placing explosives directly in contact with the material. This method directly transfers the explosive impulse to the material, resulting in either the fragmentation or significant deformation of the material. Explosives are used in shaped charges and explosively formed (forged) penetrators (EFPs) to deform thin metal. A shaped charge is an explosive charge with a lined ductile metal cavity having a conical or linear inverted "V" shape, specifically designed to produce a high velocity cutting or piercing jet of liner material. As the explosive is detonated it rapidly places high pressure on the liner's cone apex. The pressure causes the material to go through "hydrodynamic flow"—as though it were a liquid-although the reaction does not cause it to melt. The resulting jet is a stream of metal particles traveling up to 10 km/sec. Shaped charges are generally used to penetrate their targets by producing a small hole and eroding away the material it collides with. Because the jet is inherently unstable, it particulates and breaks up within a short distance. In an EFP, when the explosive detonates, the liner is severely deformed, inverted (turned inside out), or in some cases collapses and travels at supersonic velocities under 4 km/sec.

Explosives are also used in anti-missile systems warheads and claymore mines to accelerate metal spheres and cubes directly to achieve high velocities. Some deformation of the cubes and spheres is produced. As the sizes of these cubes and spheres are scaled up, the level of deformation increases to the level that severe damage, crushing and fragmentation can be observed. In this method, the material will arrive at the target area in a randomly scattered, spread out fashion.

While the aforementioned methods of delivering materials using an explosive event are sufficient for some applications, they cannot deliver a single, monolithic projectile with the precision and accuracy of the gun system.

SUMMARY OF THE INVENTION

This invention uses explosive energy in a fundamentally new fashion. Accordingly, it is the object of this invention to provide a device that, using an explosive event, reproducibly delivers a ballistically stable monolithic projectile to a specified target without deforming or fragmenting that projectile.

It is a further object of this invention to provide a device that delivers a projectile to a specified target without substantial deformation of the projectile using an explosive event.

It is a still further object of this invention to provide a device that has little or no recoil upon initiation, and, therefore, can be readily mounted for deployment.

It is a still further object of this invention to provide a device that can deliver different sized and shaped projectiles at different velocities in order to use the device in numerous applications.

This invention is unique in that it employs an explosive event, rather than traditional pyrotechnic combustion energy confirmed within a pressure vessel, to propel a low velocity projectile, whereby the projectile accounts for the majority of the system weight. This invention is also unique in that all system components, with the exception of the projectile, are consumed, in the explosive event.

The invention described herein can be employed to accelerate a projectile without causing mechanical breakup or significant deformation of the projectile and deliver the projectile, in a reproducible method, to a specific target at a specific velocity.

The invention can be used for many purposes including rendering safe a firing train to more safely disarm or dispose of UXO as previously described.

BRIEF DESCRIPTION OF THE DRAWINGS

The accompanying drawing is, which are incorporated in and constitute a part of the specification, illustrate embodiments of the invention, and, together with the description, serve to explain the principles of the invention.

FIG. 1 is a cross-sectional side view of an embodiment of the invention;

FIG. 2 is an exploded side view of an embodiment of the invention; and,

FIG. 3 is a side view of the embodiment of the invention set forth in FIG. 2 that is mounted on a tripod device.

DESCRIPTION OF THE PREFERRED EMBODIMENT

The invention, as embodied and broadly described herein, is an explosively driven projectile device used for accurately delivering a non-fragmented, ballistically stable, single, monolithic projectile, in a reproducible fashion, to a specific target at a specific velocity using an explosive event. Due to the nature of using an explosive event for energy to deliver the projectile, the device is designed to be used one time for this purpose.

In the embodiment depicted if FIG. 1, the shock driven projectile device comprises an open ended tubular housing 104 having a first open end 114 and a second open end 116, a projectile 102 having a front side 118 and back side 120 retained within the housing 104 with the front side 118 proximate to the first open end 114, an explosive fill material 108 retained within the housing 104 proximate to the back side 120 of the projectile 102 forming a cavity 112 there between, an end cap 106 covering the second end 116 of the housing 104, and, means for initiating 110 the explosive fill material depicted in this embodiment as an electric blasting cap.

The open ended tubular ho using 104 can be made of numerous frangible materials such as metal, plastic, phenolic, fiberglass, plaster, rubber, foam, paper, cardboard, wood, fiber-board, bakelite (a synthetic thermosetting phenol-formaldehyde resin), reinforced resins, ceramics, stone, cement, and concrete. It is important, however, that the housing 104 material be sufficiently light and rugged to make the device easily transportable, safe, and survivable. Therefore, the material is preferably a low density, frangible material that is not susceptible to storing a static electric charge. One preferred material is polyvinylchloride (PVC). As noted above, the device is designed to be used one time, so the preferred embodiment comprises an inexpensive housing 104 material that possesses the physical properties necessary wherein the housing 104 substantially decomposes upon ignition of the explosive fill material leaving only small fragments. For example, when the housing 104 material is PVC, low-density fragments (approximately 1.34 grams/cubic centimeter) are produced when the device is initiated. Based upon testing, the fragments are distributed radially around the device for approximately three feet. The most significant fragments are approximately 1–2 grams and are about the size of a dime. While the preferred embodiment comprises such a material, the substantial decomposition is not necessary for the invention to function in delivering the projectile 102. Substantial decomposition of the housing 104 material merely alleviates clean up of material fragments subsequent to employing the device while minimizing the collateral damage that can potentially be caused by such fragments. In the embodiment depicted in FIG. 2, a combination of an outer housing 204(*b*) and a sleeve 204(*a*) make up the housing portion of the invention. In this embodiment, the outer housing 204(*a*) and the sleeve 264(*b*) may be constructed of different materials. In the preferred embodiment of the invention, the outer housing 204(*a*) is constructed of one-quarter inch PVC and the sleeve 204(*b*) is a PVC pipe or a plastic injection molded cylinder. Materials such as those described above may be used for the construction and are well known in the art.

Referring again to FIG. 1, the projectile 102 is retained near the first end of the housing. In a preferred embodiment of the invention the projectile 102 comprises a minimum length to diameter ratio from about 0.4 to about 0.6 for a length of approximately 1.0 inches for the projectile 102 or a more preferred length to diameter ratio from about 0.8 to about 1.2 for a projectile length of approximately 2.0 inches. Certain high yield strength materials are preferred for the projectile 102 dependent upon the velocity desired for launching the projectile 102. Under preferred conditions, minimum yield strength of approximately 70 kpsi is required to ensure that no substantial deformation of the projectile occurs,. When the device is used to render safe a UXO, the projectile 102 must penetrate the target to some degree, and crush components and/or force the fuzing components out of line. A low strength projectile 102 will mushroom on impact, producing a growing surface area, and subsequent greater projectile 102 deceleration than a higher strength material. The kinetic energy of the projectile 102 is also consumed in plastically deforming the projectile 102 rather than disrupting the fuze. Examples of the types of materials that may be used to construct the projectile 102 include but are not limited to A-286 grade stainless steel, inconel 718, titanium, tungsten, 310 grade stainless steel, engineered ceramics, and engineered plastics. As noted above, it is important that the device be sufficiently light as to make it easily transportable. However, due to the minimum yield strength requirements regarding the projectile 102 for many preferred embodiments of this invention, the projectile 102 will usually comprise a mass greater than the combined mass of the housing 104, the explosive fill material 108, the end cap 106, and the initiating means 110. Preferably, the projectile 102 will comprise from about 60% to about 75% of the entire device's mass. In one preferred embodiment, the projectile 102 comprises a mass of approximately 400 grams. The projectile 102 set forth in FIG. 1 and FIG. 2 depicts one of the most preferred shapes. Referring to FIG. 1, the back side 120 of the projectile 102 comprises an outward conical shape having an angle 122. The angle 122 comprises an arc preferably from about 110° to about 150° and more preferably approximately 130°. The angle 122 serves two purposes: (1) it defines the geometry of the cavity 112 between the explosive fill material 108 and the projectile 102 and, in doing so, displaces the gas pressure across a large surface area to ensure the projectile 102 survives the explosive event and, (2) it diverts the blast products generated during th[]e detonation of the device away from the object targeted for the projectile 102 attack. In doing so, the axial momentum delivered from the explosive fill material 108 to the projectile 102 is diminished in a controlled fashion. The front side 118 of the projectile 102 is blunt and of a smaller diameter than the back side 120 in its preferred embodiment, such to exhibit a plugging mode of target perforation and reduced tendency to ricochet. Blunt, conical and spherical tipped projectiles 102 were evaluated and tested. Pointed penetrators exhibit a piercing action. The penetration of a slug cam be improved significantly by the proper selection of tip diameter without increasing the pressure levels experienced by the fuze components.

Referring again to FIG. 1, the explosive fill material 108 is placed near the back side 120 of the projectile 102 forming a cavity 112 there between. The formation of the cavity 112 is important to the present invention as the substance within the cavity 112 is used as a transfer media for the pressure, produced by the detonation of the explosive fill material 108, to the projectile. In the absence of the cavity 112, the pressure produced by the detonation of the explosive fill material 108 would cause the projectile 102 to catastrophically fail, producing high velocity fragments rather than a single projectile 102. In one preferred embodiment of the invention, the cavity 112 contains only air. However, other materials such as liquids, other gases, gels, foams, and plastics may be introduced into the cavity 112 in order to transfer the explosive energy to the projectile 112 at different rates. The volume of the cavity 112 and the media contained within the cavity may be changed to adjust the projectile 102 velocity by one skilled in the art. Along with certain physical characteristics of the device, the projectile 102 velocity is governed by the type, geometry, and amount of the explosive fill material 108 placed within the device. In the most preferred embodiment of the invention, an explosive fill material 108 that produces detonation velocities of from about 6 km/s to about 9 km/s is used. Explosive fill materials 108 that produce such detonation velocities are well known in the art. Such materials include compositions of RDX (Cyclotrimethylenetrinitramine), HMX (Cyclotetrunethylenetetranitramine): TNT (Trinitrotoluene), PETN, and ammonium nitrate. The most preferred explosive fill materials 108 would be thin explosive pellets formed through either casting or pressing. An example of this type of material is PBXN-9 plastic explosives, whose base formulation is HMX. Also, hand packed plastic explosive discs, such as Composition C-4 (RDX formulation), can be fabricated in this manner.

The end cap 106 fits over the second end 116 of the housing 104 near the explosive fill material 108. The end cap 106 may be comprised of a different material than the housing 104. However, the principles espoused above regarding light weight and substantial decomposition upon ignition of the explosive fill material 108 necessitate that the end cap 106 be constructed of a material similar to that used in constructing the housing 104. As with the housing 104 material, the preferred material for the end cap 106 is a low-density, frangible material. A small hole 124 is formed within the end cap 106 in order to insert the initiating means 110 discussed below.

The initiating means 110 set forth in FIG. 1, is inserted into the small hole 124 within the end cap 106. In this embodiment, the initiating means 110 is an electronic blasting cap. However, any other initiating means such as a fuze initiator, shock initiating device, or detonation cord can be employed. Referring again to FIG. 2, this embodiment of the invention show, an initiating means comprising a cylinder 230 protruding from the end cap 106, a booster 232 inserted into the cylinder 230, a detonator 234 placed over the booster 232, and a blasting cap 236 inserted into the detonator 234.

FIG. 3 shows the embodiment set forth in FIG. 2 mounted on a tripod type mounting device 304. This mounting means 304 allows the device to be placed on the ground and to be aimed at a specific target location wherein the device can be rapidly emplaced and activated from a safe stand-off distance. Other mounting means 304, well known in the art, may be used in order to affix the device to the ground or other stationary objects. In one preferred embodiment, the mounting means 304 comprises low magnetic signature materials.

Although this invention can be used for numerous purposes, the preferred uses of the invention relate to delivering a low velocity projectile 102 to a specified target. The general method to use the invention is to aim the shock driven projectile device at a specific target and employ the initiating means 110 using conventional demolition materials. The most preferred application of this invention is interrupting the firing train of UXO commonly found after a military action such as on a battlefield, on a test and raining range, or after any other such action. For this application, the shock wave accelerated projectile device is constructed to deliver an approximately 400 gram projectile 102 at low velocities (from about 400 fps to 900 fps) delivering 11.0–24.7 lb.-sec of momentum and 2190–11094 ft-lb, kinetic energy. The shock wave accelerated projectile device is aimed at the physical or explosive linkage within the fuze or the main explosive charge within the UXO and is then initiating means 110 are employed. The projectile 102 disrupts this firing train linkage, making the UXO safer to handle and dispose.

Due to the physical properties inherent in this invention and the way it is used to propel projectiles 102, the housing

104 material is consumed and does not recoil. Also, because of the commercial availability of many of the materials used in constructing the device, it can be constructed in a manner that is sufficiently inexpensive so that the device's single use nature is still economical. What is described is only one of many possible variations on the same invention and is not intended in a limiting sense. The claimed invention can be practiced using other variations not specifically described above.

What is claimed is:

1. A shock wave accelerated projectile device, comprising:

an open ended tubular housing having a first open end and a second open end;

a projectile having a front and back side, wherein the back side comprises a conical shape having an outward angle, retained within the housing with the front side aligned proximate to the first open end;

an explosive fill material that detonates retained within the housing proximate to the back side of the projectile forming a cavity there between, an end cap covering the second open end of the housing;

means for initiating the explosive fill material; and, a small opening formed in the end cap wherein the means for initiating are capable of being placed.

2. The shock wave accelerated projectile device system of claim 1, wherein the angle comprises an arc from about 110° to an arc of about 150°.

3. The shock wave accelerated projectile device of claim 2, wherein the projectile comprises a minimum length to diameter ratio from about 0.4 to about 0.6.

4. The shock wave accelerated projectile device of claim 3, wherein the projectile comprises a minimum yields strength of approximately 70 kpsi.

5. The shock wave accelerated projectile device of claim 4, wherein the angle comprises an arc of approximately 130°.

6. The shock wave accelerated projectile device of claim 4, wherein the projectile comprises a length to diameter ratio from about 0.8 to about 1.2.

7. The shock wave accelerated projectile device of claim 6, wherein the projectile comprises a length from about 1.0 inches to about 2.5 inches.

8. The shock wave accelerated projectile device of claim 4, wherein the projectile comprises a mass greater than 50% of the shock driven projectile device.

9. The shock wave accelerated projectile device of claim 8, wherein the projectile comprises a mass of from about 60% to about 75% of the shock driven projectile device.

10. The shock wave accelerated projectile device of claim 9, wherein the projectile comprises a mass of approximately 400 grams.

11. The shock wave accelerated projectile device of claim 4, wherein the explosive fill material produces a detonation velocity from about 6 km/s to about 9 km/s.

12. The shock wave accelerated projectile device of claim 4, wherein the housing substantially decomposes upon detonation of the explosive fill material.

13. The shock wave accelerated projectile device of claim 4, wherein the housing comprises PVC.

14. The shock wave accelerated projectile device of claim 4, further comprising a fluid contained within the cavity.

15. The shock wave accelerated projectile device of claim 4, further comprising:

a means for mounting the shock driven projectile device wherein the shock driven projectile device can be fixed and aimed.

* * * * *